US005836686A

United States Patent [19]

Ogier

[11] Patent Number: 5,836,686

[45] **Date of Patent: *Nov. 17, 1998**

[54] MULTI-CHAMBER HIGH PRESSURE DISPERSION APPARATUS

[75] Inventor: Ray Ogier, Ontario, Canada

[73] Assignee: Chem Financial, Inc., Canada

[ * ] Notice: The term of this patent shall not extend beyond the expiration date of Pat. No. 5,624,186.

[21] Appl. No.: 797,481

[22] Filed: Feb. 6, 1997

Related U.S. Application Data

[63] Continuation-in-part of Ser. No. 597,692, Feb. 6, 1996, Pat. No. 5,624,186.

[60] Provisional application No. 60/014,786 Apr. 3, 1996.

[51] Int. Cl.[6] ..... B01F 15/02

[52] U.S. Cl. ..... 366/176.1; 366/182.2; 366/262

[58] Field of Search ..... 366/262, 263, 366/264, 270, 279, 3, 14, 15, 176.1, 176.2, 177.1, 178.1, 182.2

[56] References Cited

U.S. PATENT DOCUMENTS

| | | | |
|---|---|---|---|
| 3,679,182 | 7/1972 | Clocker | 366/263 |
| 3,941,355 | 3/1976 | Simpson . | |
| 3,942,765 | 3/1976 | Henrickson . | |
| 4,087,862 | 5/1978 | Tsien . | |
| 4,294,549 | 10/1981 | Thompson et al. | 366/263 |
| 4,806,019 | 2/1989 | Lutwick et al. . | |
| 4,834,542 | 5/1989 | Sherwood | 366/363 |
| 4,850,704 | 7/1989 | Zimmerly et al. | 366/264 |
| 4,944,602 | 7/1990 | Buschelberger . | |
| 4,989,988 | 2/1991 | Hütter et al. . | |
| 5,624,186 | 4/1997 | Ogier | 366/176.1 |

*Primary Examiner*—Tony G. Soohoo

*Attorney, Agent, or Firm*—Gifford, Krass, Groh, Sprinkle, Patmore, Anderson & Citkowski, P.C.

[57] ABSTRACT

A method and apparatus for mixing two or more materials which are difficult to mix. The dispersion apparatus has a cylindrical housing which is divided into an upper chamber and a lower chamber by a separator. The materials to be mixed are forced under pressure into the lower chamber which is divided into pressure zones by kinetic baffles. A turbine blade imparts energy to the liquids which are kept from swirling by the kinetic baffles. The high pressure of the materials introduced into the chamber forces the materials through an opening between the baffle and shaft turning the blade into the upper chamber. In the upper chamber a second blade imparts centrifugal force to the materials to force them outward. The materials are sheared as they move through the apparatus and then are delivered to an outlet.

11 Claims, 3 Drawing Sheets

MULTI-CHAMBER HIGH PRESSURE DISPERSION APPARATUS

RELATED INFORMATION

This is a continuation-in-part of application Ser. No. 08/597,692, filed Feb. 6, 1996, now U.S. Pat. No. 5,624,186, and the added material taking priority from Provisional Application Serial No. 60/014,786, filed Apr. 3, 1996.

BACKGROUND OF THE INVENTION

1. Field of the Invention

This invention relates to a method and apparatus for mixing two or more materials which are difficult to mix. More particularly, this invention relates to a method and apparatus for dispersion utilizing both static and dynamic mixing.

2. Description of the Prior Art

It is known to mix materials and mediums normally considered difficult to intermix, for example, fatty acids and caustic solutions. The immiscible liquids are introduced into a chamber, and a rotor is used to impart energy to the liquids to produce a mixture. However, rotary mixers tend to create vacuum zones and are relatively inefficient in imparting energy to the liquids.

It is also known to use static mixers, such as disclosed in U.S. Pat. No. 3,942,765, wherein a motionless elongated mixing element is disposed within a tubular body to intercept and shear material being mixed. The mixing element has a plurality of triangular elements extending on either side of a common center line. The triangular elements are in an axially staggered relationship. The mixing element is placed in a fluid flow of two immiscible phases. The triangular elements intercept and "bend" two immiscible phases together as they pass through the tubular body. However, this device requires substantial space and is not particularly effective in mixing immiscible materials.

Accordingly, it is desirable to provide a device which effectively mixes immiscible materials which is economical and efficient in its application. It is, therefore, an object of the invention to provide a dispersion apparatus which efficiently imparts high energy to produce superior mixing results.

It is further an object of the invention to produce a dispersion apparatus which is easily disassembled for cleaning and use in food processing.

It is also an object of the invention to produce a method and apparatus for mixing utilizing both static and dynamic mixing.

SUMMARY OF THE INVENTION

Disclosed is a two-stage dispersion apparatus having a cylindrical housing which is divided into an upper chamber and a lower chamber by a partition. An axially disposed shaft extension passes through the partition to turn one turbine blade in the lower chamber and a second turbine blade in the upper chamber. A distribution ring having a circumferential skirt is mounted to the end of the shaft extension and is axially aligned with a primary inlet formed in a bottom wall of the lower chamber. Fluid material or particulate matter is pumped under high pressure upwardly through the primary inlet and into the skirt of the distribution ring.

In a first embodiment, the liquid is forced through a plurality of radial holes in the skirt to direct the first fluid radially outwardly into pressure zones formed between "L" shaped kinetic baffles mounted in the chamber.

In a second embodiment, the liquid is forced through a plurality of radial holes and between paddles on the skirt to direct the first fluid radially outwardly into pressure zones formed between polygonal kinetic baffles mounted on the bottom wall of the lower chamber. These polygonal baffles are preferably rectangular in shape and disposed to induce a counterrotation to the rotation of the fluid caused by the turbine having multiple blades. The kinetic baffles, regardless of specific shape, are angled so that the angle of incidence $\Theta$ of the baffle with respect to the direction of rotation of the turbine at any point is less than 90°.

The chamber separation plate has a set of kinetic baffles extending into the lower chamber to induce rotation in the liquid before the high input pressure forces the materials upwardly into an annular opening between the shaft extension and chamber separation plate into the upper chamber. The chamber separation plate has a second set of baffles on the upper chamber side to induce counterrotation. An additional set of baffles are positioned on the gland plate to induce rotation of the fluid within the upper chamber.

The invention in its various embodiments has on the bottom wall a secondary inlet positioned between the baffles, to introduce a second material into one of the pressure zones of the lower chamber. The turbine imparts energy to the materials. The high input pressure forces the materials upwardly into an annular opening between the shaft extension and baffle plate into the upper chamber. The materials are then directed outwardly by the second blade through a porous screen and through an outlet for further processing. A sonicator element is optionally mounted within the housing to further facilitate mixing.

BRIEF DESCRIPTION OF THE DRAWINGS

The invention will be described further by way of examples in which reference to the accompanying drawings in which.

DESCRIPTION OF THE PREFERRED EMBODIMENTS

Figures 1, 2:
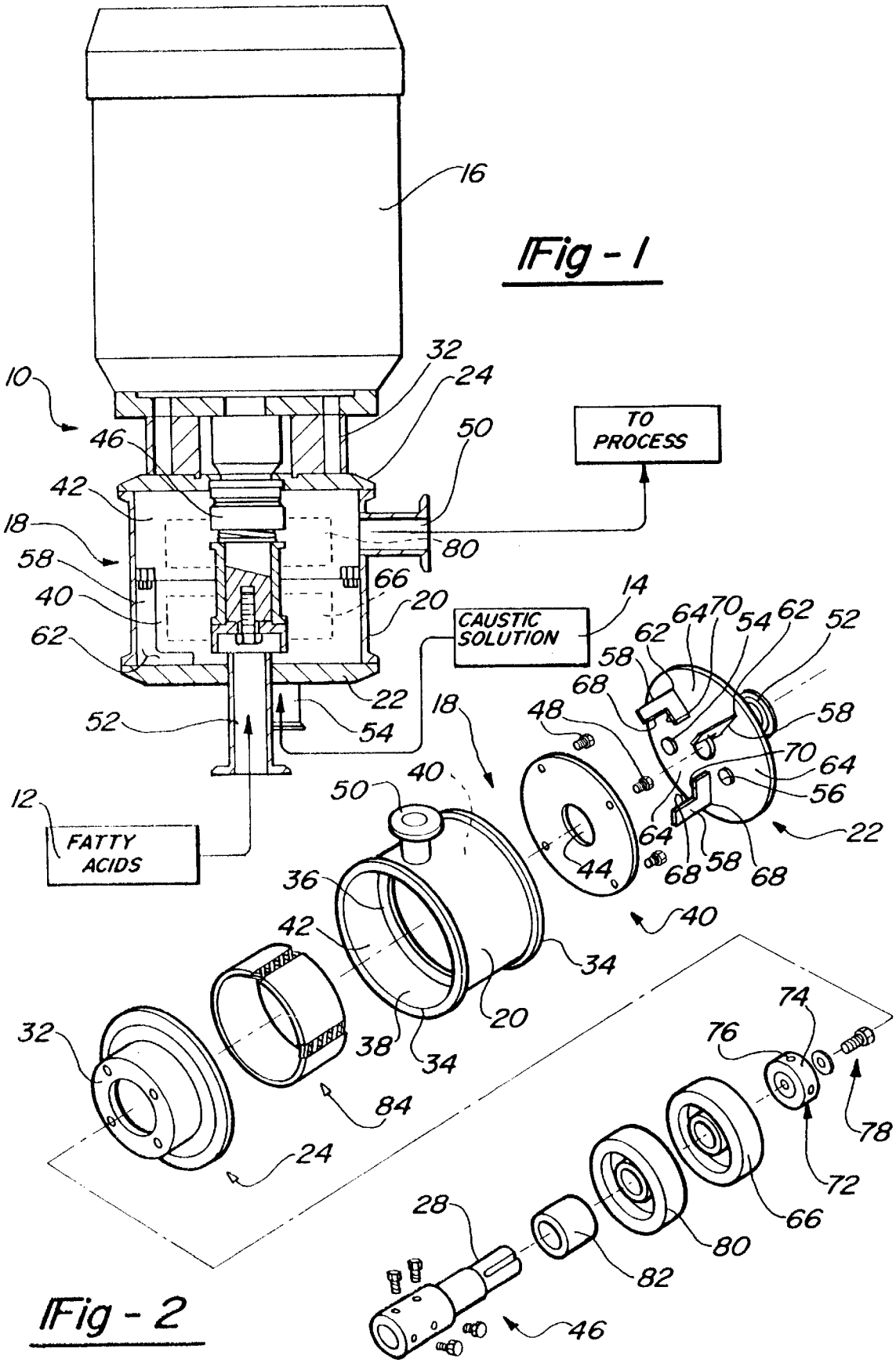
FIG. 1 is a sectional plan view of a dispersion apparatus in accordance with the invention.
FIG. 2 is an exploded perspective view of a representative two-stage mixing chamber in accordance with the invention.

Shown in FIG. 1 is a multi-stage dispersion apparatus 10 constructed in accordance with the present invention and suitable for mixing immiscible phases. Although shown here in conjunction with mixing fatty acids 12 and caustic solution 14, the dispersion apparatus 10 is suitable for use in a number of materials, particularly, fluids which are immiscible. The dispersion apparatus is easily disassembled for cleaning which results in being particularly useful in mixing foodstuffs for the food service industry, and latexes for the paint and coatings industry.

As shown in FIG. 1, the dispersion apparatus 10 includes an electric motor 16 mounted above a two-stage mixing chamber 18. The electric motor 16 is mounted to a gland plate adapter 32 to support the motor 16 above the mixing chamber 18. The gland plate adapter 32 is satisfactory for mounting any C-face electric motor. The motor 16 turns a shaft 46 having a pair of blades as set forth below.

The mixing chamber 18 includes a cylindrical body 20 closed at a lower end by an inlet plate 22 and by a gland plate 24 enclosing an upper end.

As shown in FIG. 2, the housing 20 is cylindrical, having a pair of end flanges 34 for attachment of the input plate 22 and gland plate 24. The plates are attached to the housing by fasteners such as sanitary clamps (not shown). A baffle support ring 36 is mounted to an interior wall 38 of the housing 20 midway between the flanges 34 for mounting of a chamber separator plate 40 to form a first stage lower chamber 41 adjacent the inlet plate 22 and a second stage upper chamber 42. The chamber separator plate 40 has a central aperture 44 for receiving the shaft 46. An annular passage is formed between the center aperture 44 and the shaft 46. The baffle plate 40 is mounted by screws 48 or the like to the baffle support ring 36. An outlet 50 extends radially from the upper chamber 42 of the housing to deliver the material after it has been mixed for further processing or use.

Figure 4:
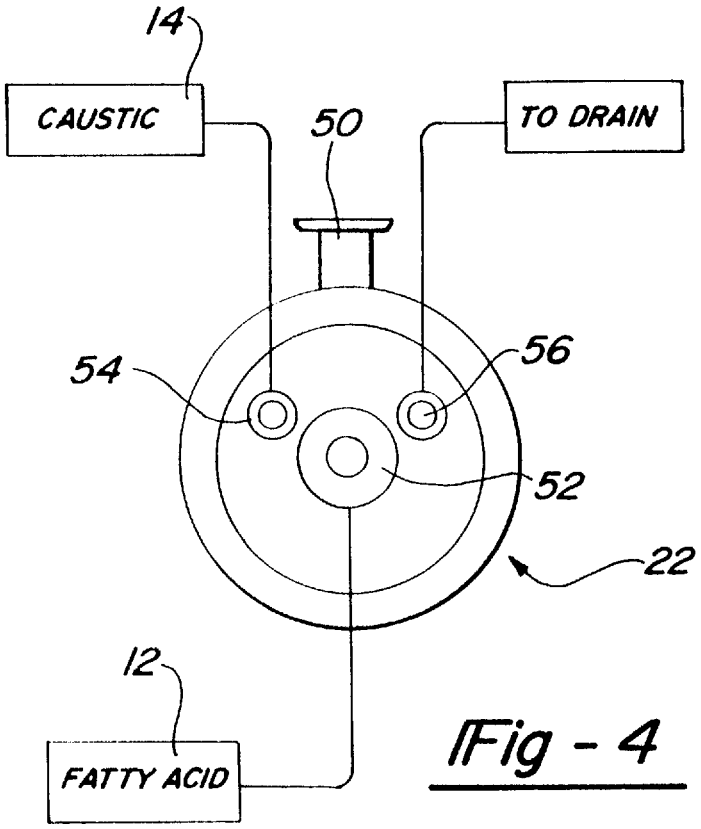
FIG. 4 is a plan view of the bottom of the two-stage mixing chamber in accordance with the invention.

As shown in FIGS. 2 and 4, the inlet cap 22 has a primary inlet port 52 aligned along the central axis for introducing a liquid, such as fatty acid solution 12, at high pressure upwardly into the lower chamber 40. A secondary inlet port 54 and a drain 56 are disposed radially outwardly from the primary port 52. The secondary inlet port 54 is connected to a supply of a second material, such as caustic solution 14, to be mixed with the first material from the primary inlet port 52. The drain 56 facilitates the emptying of the mixing chamber 18 prior to cleaning.

As shown in FIGS. 1 and 2, three L-shaped kinetic baffles 58 are mounted to the inside of the inlet plate 22, to form three pressure zones 64, FIG. 2. The L-shaped baffles 58 are disposed radially outwardly from the primary inlet port 52 with a long portion extending along the internal wall 38 of the housing 20. The baffles 58 are spaced approximately 120° apart and have interior edges 68, 70 forming about a right angle. The L-shaped kinetic baffles 58 optionally have apertures therethrough (not shown). The apertures function to modify the mixing dynamic. It is appreciated that the other kinetic baffles utilized in the instant invention are similarly amenable to perforation. A small aperture 62 is formed between the interior wall 38 of the housing and the long portion 60 of the baffles to permit a small amount of fluid to pass between adjacent pressure zones 64.

As shown in FIGS. 1 and 2, a turbine blade 66 is mounted in the lower chamber 40 on the shaft 46. The turbine 66 is positioned to pass closely to interior edges 68, 70 of the baffles 58 so that there is a small distance between the turbine 66 and the edges of the kinetic baffles 58. A distribution ring 72 is mounted to the distal end of the shaft extension 46. The ring 72 has a downwardly depending skirt 74 having lower apertures 76 extending radially through the skirt 74. The ring 72 is mounted to the shaft extension by a bolt 78.

A second turbine 80 is mounted within the upper chamber 42 of the housing 20. A spacer 82 is positioned on the shaft 46 between the turbine blade and a shoulder 28 on the shaft 46 to position a turbine within the upper chamber 42. A porous screen 84 having a porosity of approximately ⅛ inch on 3/16 inch centers is positioned to extend between the gland plate 24 and the baffle plate 40 within the upper chamber. It is appreciated that the screen porosity is variable dependent on the particulate content and viscosity of the mixture. The screen 84 is cylindrical and has a diameter greater than the diameter of the blade 80, but less than the inner wall 36 of the housing 20 so that all material exiting the housing through the outlet 50 must pass through the screen 84.

Figure 5:
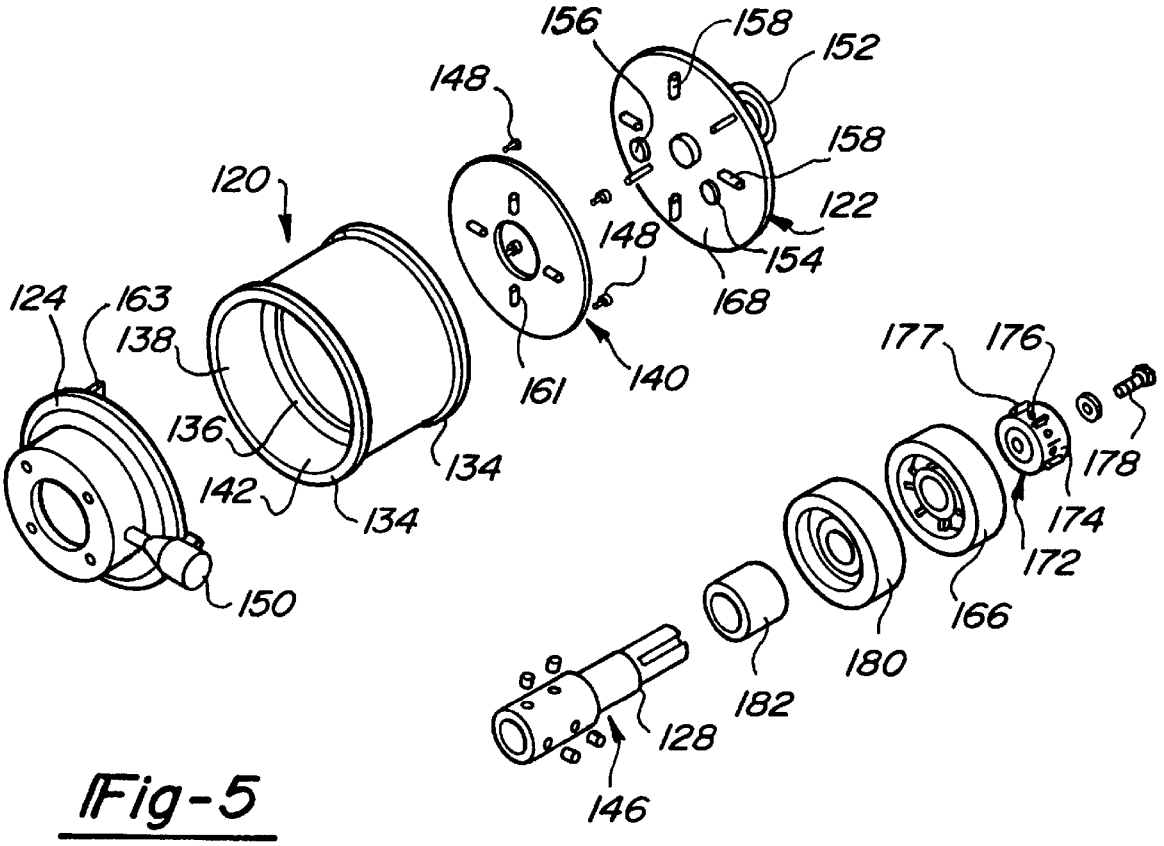
FIG. 5 is an exploded perspective view of an alternative embodiment of a two-stage mixing chamber in accordance with the invention.

A second embodiment of the invention is illustratively represented as shown in FIG. 5, the housing 120 is cylindrical, having a pair of end flanges 134 for attachment of the input plate 122 and gland plate 124. The plates are attached to the housing by fasteners such as sanitary clamps (not shown). A support ring 136 is mounted to an interior wall 138 of the housing 120 midway between the flanges 134 for mounting of a chamber separator 140 to form a first stage lower chamber 141 adjacent the inlet plate 122 and a second stage upper chamber 142. The chamber separator 140 has a central aperture 144 for receiving the shaft 146. An annular passage is formed between the center aperture 144 and the shaft 146. The chamber separator 140 is mounted by screws 148 or the like to the support ring 136. An outlet 150 is formed in the gland plate to extend axially from the center of the upper chamber 142 and then radially outwardly to deliver the material after it has been mixed for further processing or use.

The inlet plate 122 functions in a similar manner to that of inlet plate 22, as detailed in regard to FIGS. 2 and 4. A similar arrangement of ports and a drain facilitates mixing and cleaning, respectively.

Figures 6A, 6B, 6C, 6D:
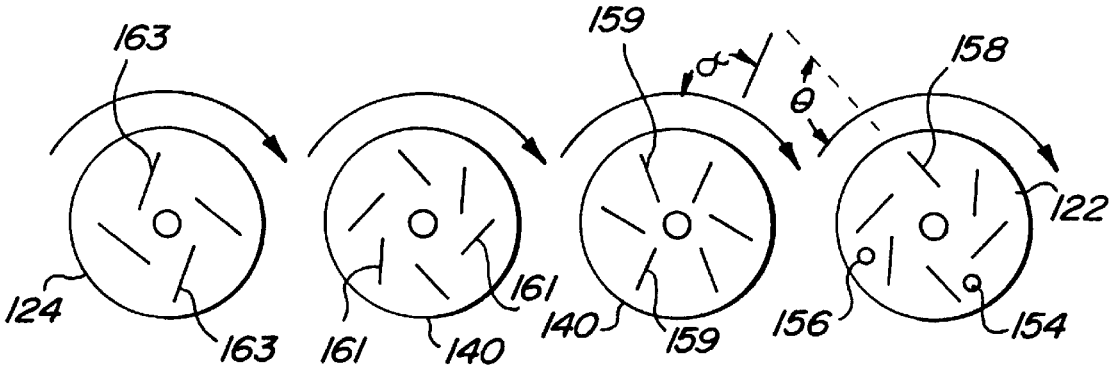
FIGS. 6A, 6B, 6C and 6D show the alignment of baffles with respect to the rotational movement of the liquid in accordance with the second embodiment of the invention.

As shown in FIGS. 5 and 6A, six rectangular-shaped kinetic baffles 158 are mounted to the inside of the inlet plate 122 to form pressure zones. The rectangular-shaped baffles 158 are disposed generally radially outwardly from the primary inlet port 152, however, and are angled with respect to the rotation of the mass of the fluid such that the angle of incidence $\Theta$ of the baffles extending outwardly in the radial direction is less than 90°. The optimal angle of incidence is dependent on many factors, including the mixing material shear properties and the speed of shaft 146 rotation. A secondary inlet port 154 and a drain plug.

As shown in FIG. 5, a turbine 166 having multiple blades is mounted in the lower chamber 141 on the shaft 146. A turbine 166 having at least two, and less than twenty blades is preferred. A turbine having between four and eight blades is more preferred. A turbine having six blades is most preferred. The turbine 166 is positioned to pass closely to interior edges 168 of the baffles 158 so that there is a small distance between the blades and the edges of the kinetic baffles 158.

A distribution ring 172 is mounted to the distal end of the shaft extension 146. The ring 172 has a downwardly depending skirt 174 having multiple apertures 176 extending radially through the skirt 174. A skirt having between four and thirty-six apertures is preferred. The ring 172 is mounted to the shaft extension by a bolt 178. Axially aligned paddles 177 are positioned between the apertures 176.

As shown in FIGS. 5, 6B and 6C, the chamber separator plate 140 has a set of baffles mounted on either face of the chamber separator (six baffles are depicted on either face in FIGS. 5, 6B and 6C). As shown in FIG. 6B, the baffles 159 on the lower chamber side of the chamber separator are aligned to induce rotation to the liquid and have an angle of incidence $\alpha$ greater than 90°. The optimal angle of incidence $\alpha$ is dependent on many factors including the mixing material shear properties and the speed of shaft 146 rotation. As shown in FIG. 6C, the baffles 161 on the upper chamber side of the chamber separator are aligned in the counterrotational direction having an angle of incidence Θ just as the baffles 158 mounted in the inside of the inlet plate 122.

A set of multiple baffles 163 are mounted on the inside of the gland plate 124 at the top of the upper chamber and depicted as a set of four baffles in the embodiment shown in FIG. 6D. The baffles 163 are mounted to induce rotation of the liquid and, accordingly, are mounted with an angle of incidence α just the same as the baffles 159 are positioned on the lower chamber side of the separator 140.

A second turbine blade 180 is mounted within the upper chamber 142 of the housing 120. A spacer 182 is positioned on the shaft 146 between the turbine blade and a shoulder 128 on the shaft 146 to position a blade within the upper chamber 142.

An annular passage adjacent the shaft 146 is formed in the gland plate 124 to deliver the mixture through the outlet 150. In this way, fine particulate located near the center of the axis of rotation are removed from the liquid after being mixed.

Operation

Figure 3:
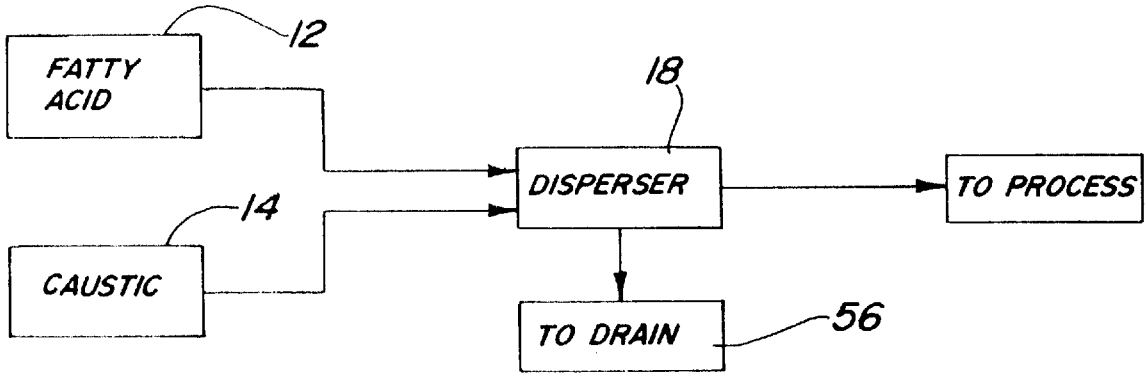
FIG. 3 is a flow chart showing use of the dispersion apparatus in accordance with the invention.

As is discussed, the multi-stage dispersion apparatus 10 imparts high energy to the phases being mixed. The energy is formed both by dynamic and static mechanisms. As shown in FIG. 3, material, such as a fatty acid 12, is introduced through the primary input port 52 under pressure, for instance 150 lbs/inch, into the lower chamber 40. As shown in FIG. 2, the material is received within the skirt 74 of the distribution ring 72 and is forced both under the input pressure and centrifugal force outwardly through the radial apertures 76 of the skirt 77 into the three pressure zones 64 formed between the kinetic baffles 58. The turbine blade 66 causes the material to rotate and to move outwardly in each of the three pressure zones 64.

The second material is introduced through the secondary inlet 54 in one pressure zone between the baffles. The baffles 58 prevent the two materials from merely being moved as a swirling mass and around the turbine blade 66. A small amount of material is permitted to rotate from pressure zone to pressure zone 64 of the lower chamber by way of the apertures 62 in the baffles. Once directed outwardly by the turbine blade 66, the input pressure of the materials is such that it moves the combined materials upwardly through the aperture 44 in the baffle plate 40 and alongside of the shaft 46. Clearance between the shaft 46 and baffle plate 40 is such that the material is sheared as in the static mixing. The combined phase materials are then moved into the upper chamber 42 where the second blade 80 forces the material outwardly and through the fine porous screen 84. The rotation causes dynamic mixing and the screen 84 imparts energy by way of shear as the materials move through the screen 84. The porosity of the screen 84 may be controlled and coordinated with the nature of the materials being dispersed.

In regard to the embodiment shown is FIG. 5, the baffles 158 are disposed to induce a counterrotation of the fluids being mixed. The baffles 159 on the chamber separator induce rotation to the liquid before it passes through the annular aperture 144 into the upper chamber. Clearance between the shaft 146 and baffle plate 140 is such that the material is sheared as in the static mixing. The combined phase materials are then moved into the upper chamber 142 where the second blade 180 forces the material outwardly and against the baffles 161 extending in a counterrotational direction in the lower chamber. The rotation causes dynamic mixing. The gland plate 124 has an annular passage for the outlet 150 located near the center of rotation of the liquid so that the smaller or finer particulate is removed from the liquid.

To further facilitate mixing of the primary and secondary materials a conventional sonicator element 190 is optionally mounted within the housing 20 or 120 so as not to interfere with turbine blade rotation or material flow. Sonication is a process known to increase the surface area between dissimilar liquid phases and transiently raise the material temperature thereby facilitating mixing. Preferably the sonicator element 190 is mounted within the lower chamber 41 or 141.

The multi-stage dispersion apparatus 10 is particularly suited for usages where it is necessary to clean the mixing chamber, such as in food processing and latex formation. The mixing chamber is disassembled and cleaned by removing the input plate 22 first, then the dispersion ring 72 and first turbine blade 66 are removed from the shaft 46. The baffle plate 40 is then removed by unscrewing it from the support ring 36 and the second turbine blade 80, spacer 82, and screen 84 are slid out. Finally, the shaft 46 may be removed as desired and the mixing chamber may be cleaned and sterilized. The same is also true of the embodiment of the invention depicted in FIG. 5.

While the particular preferred embodiment of the invention has been shown and described, the various modifications there suggested, it will be understood that the true spirit and scope of the invention as set forth in the appended claims, which embrace other modifications and embodiments which will occur to those of ordinary skill in the art. Although the apparatus is shown with two chambers, additional chambers could be formed by adding blades and baffle plates. Additionally, the chambers could be connected in series to mix in additional materials.

Having set forth the invention, what is claimed is:

1. A dispersion apparatus for mixing a plurality of materials, said apparatus comprising:

a housing having a bottom chamber and an upper chamber;

a motor mounted to said housing for turning a shaft extending into said housing;

a chamber separator plate mounted to said housing to separate said upper chamber from said lower chamber, said chamber separator plate having an aperture for receiving said shaft therethrough and forming an annular passage therebetween;

at least two kinetic baffles mounted within said lower chamber to form pressure zones;

an inlet plate mounted to said housing and having a primary inlet and a secondary inlet for delivering said plurality of materials into said lower chamber;

a pair of turbines mounted to said shaft, said first turbine disposed in said lower chamber and said second turbine disposed in said upper chamber; and a distribution ring mounted to an end of said shaft, said dispersion ring having a skirt having a plurality of paddles.

2. The dispersion apparatus of claim 1, wherein said kinetic baffles comprise polygonal members disposed between said housing and said first turbine so as to form a pressure zone.

3. The dispersion apparatus of claim 2, wherein said kinetic baffles comprise essentially rectangular-shaped members.

4. The dispersion apparatus of claim 1, wherein said kinetic baffles comprise polygonal members disposed between said housing and said second turbine so as to form a pressure zone.

5. A method of mixing a plurality of materials comprising:

delivering a first material under pressure through a primary inlet into a lower mixing chamber;

forming a plurality of pressure zones with baffles;

delivering a second material into one of said pressure zones;

rotating said first and second materials in said lower chamber;

shearing said materials in a passage between an upper and said lower chamber;

rotating said materials in said upper chamber; and collecting said materials from near the center of said upper chamber.

6. The method of claim 5, wherein said delivering steps further comprise delivering said first and second materials in an upward direction into said lower chamber.

7. The method of claim 6, further comprising a step of forcing said first material axially outwardly through a skirt of a dispersion ring into said lower mixing chamber.

8. A dispersion apparatus for mixing a plurality of materials, said apparatus comprising:

a housing having a bottom chamber and an upper chamber; a motor mounted to said housing for turning a shaft extending into said housing;

a chamber separator plate mounted to said housing to separate said upper chamber from said lower chamber, said chamber separator plate having an aperture for receiving said shaft therethrough and forming an annular passage therebetween, said chamber separator plate having attached thereto a plurality of baffles disposed in said upper chamber;

at least two kinetic baffles mounted within said lower chamber to form pressure zones;

an inlet plate mounted to said housing and having a primary inlet and a secondary inlet for delivering said plurality of materials into said lower chamber; and a pair of turbines mounted to said shaft, said first turbine disposed in said lower chamber and said second turbine disposed in said upper chamber.

9. The dispersion apparatus of claim 8, wherein said chamber separator plate further comprises a plurality of baffles disposed in said lower chamber.

10. A dispersion apparatus for mixing a plurality of materials, said apparatus comprising:

a housing having a bottom chamber and an upper chamber;

a motor mounted to said housing for turning a shaft extending into said housing;

a chamber separator mounted to said housing to separate said upper chamber from said lower chamber, said chamber separator plate having an aperture for receiving said shaft therethrough and forming an annular passage therebetween;

at least two kinetic baffles mounted within said lower chamber to form pressure zones;

an inlet plate mounted to said housing and having a primary inlet and a secondary inlet for delivering said plurality of materials into said lower chamber;

a pair of turbines mounted to said shaft, said first turbine disposed in said lower chamber and said second turbine disposed in said upper chamber; and a gland plate having a plurality of baffles, said gland plate mounted to said housing so as to be adjacent to the upper chamber of said housing, and said gland plate is adapted to induce rotation in the materials.

11. The dispersion apparatus of claim 10, wherein said gland plate further comprises an outlet through which particulate is removed from the materials.

* * * * *